United States Patent [19]

Susdorf

[11] 3,937,293

[45] Feb. 10, 1976

[54] DRIVE ARRANGEMENT FOR A TRACK-BOUND ELECTRIC SELF-PROPELLED VEHICLE

[75] Inventor: Roman Susdorf, Berlin, Germany

[73] Assignee: Siemens Aktiengesellschaft, Munich, Germany

[22] Filed: Oct. 3, 1974

[21] Appl. No.: 511,718

[30] Foreign Application Priority Data

Oct. 26, 1973 Germany ..... 2354301

[52] U.S. Cl. ..... 180/65 F; 74/750 R; 310/89

[51] Int. Cl.[2] ..... B60K 7/00

[58] Field of Search ..... 180/65 F, 43 B, 44 E, 65 R; 74/750 R, 801; 310/89

[56] References Cited

UNITED STATES PATENTS

| | | | |
|---|---|---|---|
| 2,258,328 | 10/1941 | Lee et al. | 180/65 F |
| 2,538,548 | 1/1951 | Zimmerman | 74/750 R |
| 3,371,236 | 2/1968 | Swanke | 310/89 |
| 3,387,502 | 6/1968 | LeTourneau | 180/65 F |
| 3,617,786 | 11/1971 | Stielper | 310/89 |
| 3,770,074 | 11/1973 | Sherman | 180/65 F |

FOREIGN PATENTS OR APPLICATIONS

| | | | |
|---|---|---|---|
| 363,922 | 12/1931 | United Kingdom | 180/65 F |

*Primary Examiner*—M. Henson Wood, Jr.
*Assistant Examiner*—David M. Mitchell
*Attorney, Agent, or Firm*—Kenyon & Kenyon Reilly Carr & Chapin

[57] ABSTRACT

A drive arrangement for a track-bound self-propelled vehicle includes a separate, high-speed electric propulsion motor for each driving wheel. The pinion of the propulsion motor forms the sun gear of a planetary drive. A stationary axle is provided for the driving wheel which also serves as the planet carrier for the planet gears which drive the ring gear. The ring gear in turn drives the hub of the driving wheel.

4 Claims, 1 Drawing Figure

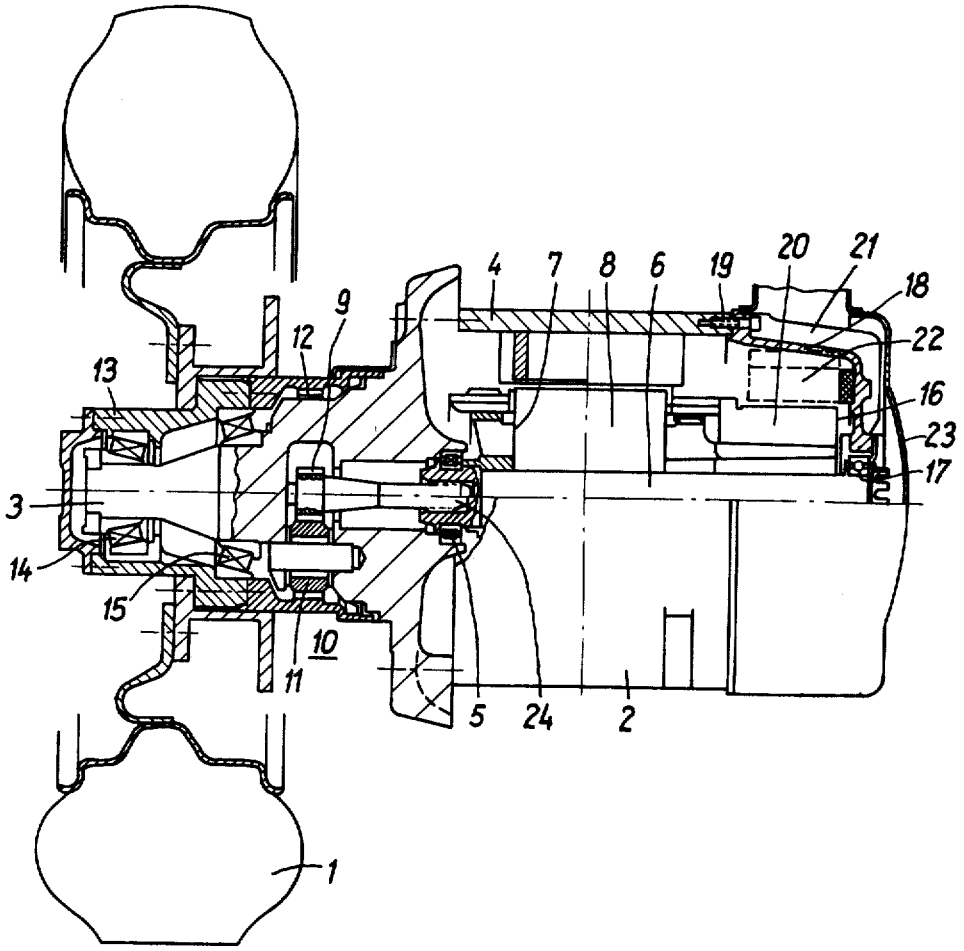
4
7
8
6
19
20
21
18
22
16
23
17
9
12
13
3
14
15
10
11
5
24
2
1

DRIVE ARRANGEMENT FOR A TRACK-BOUND ELECTRIC SELF-PROPELLED VEHICLE

BACKGROUND OF THE INVENTION

Deutsche Offenlegungsschrift 2,208,036 describes a drive of a track-bound electric propulsion vehicle with a high-speed electric propulsion motor whose pinion forms the sun gear of a planetary drive with a stationary arm, the vehicle being constrained to follow a fixed path determined by the track. This planetary drive serves to drive the driving wheels. In the known drive, double reduction is provided wherein the rotating internal gear of the planetary drive is connected with an internal-gear pinion which engages with a bull gear fastened on the driving axle. Also the electric propulsion motor is supported on the driving axle in the known drive. Notwithstanding the double reduction, a compact arrangement is achieved in this manner, and the fact is exploited that a planetary drive with a fixed arm is relatively free of maintenance.

SUMMARY OF THE INVENTION

It is an object of the invention to further reduce the volume of the above-mentioned drive. It is another object of the invention to also shorten the structural length of the drive in the axial direction.

According to a feature of the drive arrangement of the invention, a separate electric propulsion motor is provided for each driving wheel and the axle of the driving wheel is stationary, forms the stationary planet carrier of the planetary drive and is connected with the stator housing of the propulsion motor, while the hub of the driving wheel, supported on the stationary axle, is attached to the rotating ring gear of the planetary drive. Because of this separate drive of each driving wheel with an extremely space-saving transmission and propulsion motor, a connecting driving shaft becomes unnecessary. The space which would otherwise be occupied by the driving shaft is in part occupied by the propulsion motor, and furthermore, room is made for the propulsion vehicle located between the driving wheels.

Because the axle of each driving wheel is stationary, no alternating flexure stresses occur in it. The propulsion motor, together with the drive, forms a large, unsprung mass and follows all the movements of the driving wheels. Springing within the drive is not provided but is in the support of the propulsion vehicle itself, whose cabin is suspended at the stator housing of each propulsion motor.

Because the high-speed electric motor serving as the propulsion motor contains parts such as a commutator and brushes which require maintenance work, it is advantageous to attach the stator housing of the propulsion motor on one side to the stationary axle and to construct the propulsion motor so that the parts requiring maintenance are accessible and the rotor of the propulsion motor can be removed without affecting the assembly of the drive and the stator and therefore, the cabin suspension of the propulsion vehicle. For this purpose and according to a further feature of the invention, the bearing of the rotor shaft, which is situated in the end bell on the end facing away from the planetary drive, is advantageously constructed as a fixed bearing; whereas, the bearing situated between the end-face of the rotor on the transmission side and the pinion is a loose bearing. A pluggable coupling is provided between the pinion and the rotor shaft for removably interconnecting the pinion and rotor shaft. After loosening the fastenings of the end bell at the stator of the electric propulsion motor, the end bell, the fixed bearing and the rotor of the electric propulsion motor can be pulled out together with the inner race of the bearing constructed as a loose bearing without disturbing the initial alignment and assembly of the propulsion motor and the cabin suspension, the loose bearing being on the end-face of the propulsion motor at the transmission end. The loose bearing can have an outer race fixedly connected to the stationary structure which also supports the hub of the driving wheel and an inner race fixed on the rotor shaft so as to be removable from the outer race when the rotor is axially withdrawn from the housing.

To keep the pluggable coupling as far as possible free of flexural stresses, it is advisable to arrange it in the region of the loose bearing between the end-face of the rotor on the transmission side and the pinion. This also eliminates a separate support of the coupling parts carrying the pinion.

Although the invention is illustrated and described herein as a drive arrangement for a track-bound electric self-propelled vehicle, it is nevertheless not intended to be limited to the details shown, since various modifications may be made therein within the scope and the range of the claims. The invention, however, together with additional objects and advantages will be best understood from the following description and in connection with the accompanying drawing.

BRIEF DESCRIPTION OF THE DRAWING

The drawing is a schematic diagram, partially in longitudinal section, of a drive of a track-bound electric propulsion vehicle according to the invention. The cabin of the vehicle is not shown.

DESCRIPTION OF THE PREFERRED EMBODIMENTS OF THE INVENTION

Each driving wheel 1 of the track-bound vehicle is driven by a high-speed electric propulsion motor 2. The axle 3 of the driving wheel 1 is stationary and the stator housing 4 of the stator assembly of the electric propulsion motor 2 is fastened to the axle 3 at one side thereof. The axle 3 supports, in addition, the antifriction bearing 5 for the rotor shaft 6. The bearing 5 is situated between the pinion 9 and the end-face 7 of the rotor 8 on the transmission side.

Because the electric propulsion motor is a very high-speed motor, the driving wheels 1 are driven through a reduction gear. Thus, the pinion 9 driven by the rotor shaft 6 forms the sun gear of a planetary drive 10 with a stationary planet carrier. The stationary planet carrier is formed by the axle 3. Several, and in particular three, planetary gears 11 transmit the torque from the pinion 9 to the rotating ring gear 12 of the planetary drive 10. The gear 12 is fastened at the hub 13 of the driving wheel 1. This rotating hub 13 is supported on the stationary axle 3 by means of bearing means in the form of antifriction bearings 14 and 15.

In this drive, the electric propulsion motor 2 is thus supported in the manner of a nose-and-axle-suspension motor on the stationary axle of the driving wheel 1 and forms, together with the planetary gear 10 of the drive, a large unsprung mass which follows all movements of the driving wheel 1. A drive shaft connecting the two driving wheels is eliminated and the propulsion motor 2 is in the location of the drive shaft whereby the space required for the drive is very small.

Furthermore, through the use of a high-speed propulsion motor 2, the required power is provided by a motor with a small outside diameter. The transmission required for the step-down likewise requires little space because it is configured as a planetary drive 10. The sun gear as well as the ring gear 12 of the planetary drive 10 are supported overhung on one side, but because of the multiplicity of planetary gears 11 provided, good tooth engagement is obtained. In this manner, wear is reduced to a minimum, and furthermore, the bearings of the planetary gears 11 are not subjected to centrifugal stresses because the planetary drive 10 is one with a stationary planet carrier. In this manner, this drive of each individual driving wheel 1 is made to be extremely rugged and of compact configuration and because of its very short structural length particularly in the axial direction, the drive leaves much room for the cabin of the propulsion vehicle (not shown) which is suspended between the drive wheels 1 at the stator housing 4 of the propulsion motor 2. The short length of the drive is achieved by driving the hub 13 while having a stationary axle 3.

For the support of the rotor shaft 6 of the electric propulsion motor 2 on both ends there are provided on the transmission end-face 7 of the rotor 8, the antifriction bearing 5; and, on the commutator end-face 16, the antifriction bearing 17. This antifriction bearing 17 is constructed as a fixed bearing and is arranged in a bearing shield in the form of an end bell 18 which is fastened by means of screws 19 in the stator housing 4 of the electric propulsion motor 2. The end bell 18 is constructed to have a cup-like shape so that it covers up the entire region of the commutator 20. Because the end bell 18 furthermore consists only of four ribs 21 of a U-shaped profile arranged in a star-like formation, the commutator 20 and the brushes 22 are accessible through the openings therebetween even in the assembled condition of the rotor 8, after the air ventilation cap 23 is removed. The brushes 22 are indicated in outline fashion by broken lines and lie on the commutator 20.

The special configuration of the antifriction bearing 17 as a fixed bearing and that of the antifriction bearing 5 as a loose bearing, as well as the provision of a pluggable coupling 24 between the rotor shaft 6 and the pinion 9, however, make it further possible in the simplest manner to pull out, after loosening the screws 19, the entire rotor 8 with the rotor shaft 6 and the commutator 20 together with the antifriction bearing 17 and the end bell 18. Thus, the rotor 8 of the electric propulsion motor 2 can be disassembled for maintenance purposes at any time in the simplest manner without affecting the attachment of the propulsion motor 2 on the stationary axle 3 and the suspension of the cabin (not shown) of the propulsion vehicle on the stator housing 4 of the propulsion motor. The pluggable coupling 24 is arranged in the region of the antifriction bearing 5 so that it is kept free of additional flexural stresses as far as possible.

What is claimed is:

1. A drive arrangement for a track bound electric self-propelled vehicle having drive wheels comprising: a separate, high-speed electric motor for each of the drive wheels; a planetary gear assembly for transferring the energy developed by the motor to the drive wheel corresponding to said motor; a pinion constituting the sun gear of said planetary gear assembly; said motor including: a stator assembly incorporating a housing, and a rotor rotatably mounted in said housing for driving said pinion; said planetary gear assembly including: a stationary structure connectable to said housing, said stationary structure being the axle of the drive wheel as well as the planet carrier of said gear assembly, a plurality of planet gears each rotatably mounted on said structure and engaging said sun gear, and a ring gear also engaging said planet gears so as to be rotatable with respect to said structure; a hub for supporting thereon the drive wheel corresponding to said motor, said hub being fixedly attached to said ring gear; and, bearing means for bearing said hub on said stationary structure; said rotor having a rotor shaft for driving said pinion; said housing having a removable bearing shield at the end-face thereof facing away from said planetary gear assembly; said motor further including: a first bearing disposed in said bearing shield for accommodating a first end of said rotor shaft, said first bearing being configured as a fixed bearing; a second bearing supporting a second end of said rotor on said stationary structure, said second bearing being a loose bearing having an outer race fixedly connected to said stationary structure and an inner race fixed on said rotor shaft so as to be removable from said outer race when the rotor is axially withdrawn from said housing; and, a pluggable coupling removably interconnecting said pinion and said rotor shaft.

2. The drive arrangement of claim 1, said pluggable coupling being arranged in the vicinity of said second bearing.

3. The drive arrangement of claim 1, said bearing shield being configured so as to cover the region of the commutator of said motor.

4. The drive arrangement of claim 3, said bearing shield being configured from rib members arranged in a star-like configuration.

* * * * *